US006088888A

United States Patent [19]

Oda

[11] Patent Number: 6,088,888

[45] Date of Patent: Jul. 18, 2000

[54] SEPARABLE BOTTOM STOP ASSEMBLY OF SLIDE FASTENER

[75] Inventor: Kiyoshi Oda, Toyama-ken, Japan

[73] Assignee: YKK Corporation, Tokyo, Japan

[21] Appl. No.: 09/196,318

[22] Filed: Nov. 20, 1998

[30] Foreign Application Priority Data

Nov. 20, 1997 [JP] Japan ..... 9-361993
Oct. 7, 1998 [JP] Japan ..... 10-321239

[51] Int. Cl.[7] ..... A44B 1/04
[52] U.S. Cl. ..... 24/433
[58] Field of Search ..... 24/433, 434, 435, 24/436, 388

[56] References Cited

U.S. PATENT DOCUMENTS 2,203,005 6/1940 Wittenberg et al. .
4,139,927 2/1979 Heimberger .
4,221,026 9/1980 Kanzaka .
4,232,429 11/1980 Friedberg .
4,232,430 11/1980 Friedberg .
4,742,603 5/1988 Kasai .
5,396,685 3/1995 Wilk .

FOREIGN PATENT DOCUMENTS 0 090 873 10/1983 European Pat. Off. .
WO 92/19120 11/1992 WIPO .

*Primary Examiner*—James R. Brittain
*Attorney, Agent, or Firm*—Hill & Simpson

[57] ABSTRACT

The present invention provides a separable bottom stop assembly which can be easily operated by children or people who are handicapped with one of their hands. A coupling member and a locking member respectively provided at lower ends of left and right fastener stringers are rotatably coupled together by fitting resilient leg portions of a coupling base portion of the coupling member into a hole portion of a coupling base portion of the locking member. Then, by pulling down a slider, a lower end portion of the slider urges a pivotal abutting portion of the coupling member to pivotally move a lateral-inserting fitting portion of the coupling member to a position where the slider can be pulled up. A locking projecting portion of the coupling member climbs over a projecting portion of the locking member to be locked so as to prevent separation of the coupling member in a horizontal direction. Therefore, it is possible to easily pull up the slider by a single hand to couple and close a slide fastener.

7 Claims, 8 Drawing Sheets

SEPARABLE BOTTOM STOP ASSEMBLY OF SLIDE FASTENER

BACKGROUND OF THE INVENTION

1. Field of the Invention

The present invention relates to a separable bottom stop assembly of a slide fastener, and more particularly, to a separable bottom stop assembly of a lateral-inserting type which can be easily operated and preventing separation and detachment of a coupling member and a locking member from each other in operation.

2. Description of the Related Art

Such a conventional separable bottom stop assembly of a lateral-inserting type is disclosed in U.S. Pat. No. 4,139,927. The separable bottom stop assembly comprises a coupling portion and a locking portion respectively mounted to lower ends of left and right fastener stringers. In the assembly, the coupling portion and the locking portion are rotatably coupled together by a pin at their lower ends. An upper portion of the coupling portion is rotated toward the locking portion, and a fitting portion at an inner side of the coupling portion is inserted into a side groove of a slider which stops and abuts on a slider receiving portion of the locking portion. Then, the slider is pulled upward to couple and close the slide fastener.

In the above conventional separable bottom stop assembly of the lateral-side inserting type, after coupling the coupling portion and the locking portion mounted at the lower ends of the left and right fastener stringers by the pin, while fixing one of the fastener stringers, the other fastener stringer to which the coupling portion is mounted is pivotally moved or rotated in a horizontal direction relative to front and back faces of the slide fastener so as to fit into the side groove of the slider which is mounted to the locking portion. Then, while both the fastener stringers are kept abutting on each other so as not to separate the coupling portion and the locking portion from each other by one hand, the slider is pulled upward to couple and close the slide fastener by using the other hand. Therefore, it is difficult for children or people who are handicapped with one of their hands to operate such a separable bottom stop assembly. Thus, a realization of a separable bottom stop assembly having a coupling portion and a locking portion which are not separated from each other in operation and can be attached easily even by a single hand has been demanded.

SUMMARY OF THE INVENTION

Therefore, it is an object of the present invention to provide a separable bottom stop assembly of a slide fastener wherein such problems of the conventional art are overcome and separation and detachment of the coupling member and the locking member from each other in operation are prevented such that the slide fastener can be easily operated even by a single hand.

To achieve the above objects, according to the present invention, there is provided a separable bottom stop assembly of a lateral-inserting type of a slide fastener comprising a coupling member and a locking member snap-coupled with each other at lower ends thereof so as to be rotatable or pivotally movable in a horizontal direction relative to front and back faces of the slide fastener, an upper portion of the coupling member being pivotally moved to be fitted with and separated from a side of the locking member, wherein a separation-preventing mechanism is provided between the coupling member and the locking member for preventing separation of the coupling member in the horizontal direction after pivotally moving the coupling member to such a position that a slider can be pulled up.

By providing a detachment-preventing mechanism between the coupling member and the locking member for preventing detachment of the coupling member in a direction perpendicular to the front and back faces of the slide fastener after pivotally moving the coupling member to such a position that the slider can be pulled up, the coupling member and the locking member can be coupled further reliably.

The separation-preventing mechanism preferably includes a locking projecting portion provided at a lower end of a lateral inserting fitting portion of the coupling member and a projecting portion provided on an outer peripheral wall of the lower end of the locking member.

The separation-preventing mechanism may include a projecting portion provided on an inner peripheral wall of a hole portion formed in either of coupling base portions at the lower ends of the coupling member and the locking member, and a locking projecting portion provided on an outer peripheral wall of a resilient leg portion formed in either of the coupling base portions at the lower ends of the locking member and the coupling member of the locking member, the resilient leg portion fitting in the hole portion.

The detachment-preventing mechanism preferably includes a hole portion having a step portion provided in either of the coupling base portions of the lower ends of the coupling member and the locking member, and an engaging portion provided at an end of a leg portion in either of the coupling base portions of the lower ends of the locking member and the coupling member, the engaging portion being engaged with the step portion so that the pivotal movement of the coupling member is stopped.

The detachment-preventing mechanism may include projecting walls of front and back faces of a guide portion of the locking member which project largely toward the coupling member in such a manner that an insertion recessed groove of the locking member deeply is formed deeply, a lateral-inserting fitting portion of the coupling member being fitted into the insertion recessed groove.

By providing a pivotal abutting portion at a lower end portion of the coupling member, on which a lower end portion of the slider which has been pulled down abuts and which pivotally moves the upper portion of the coupling member to such a position that the slider can be pulled up, the separable bottom stop assembly can be operated further easily.

DESCRIPTION OF THE PREFERRED EMBODIMENTS

Figure 1:
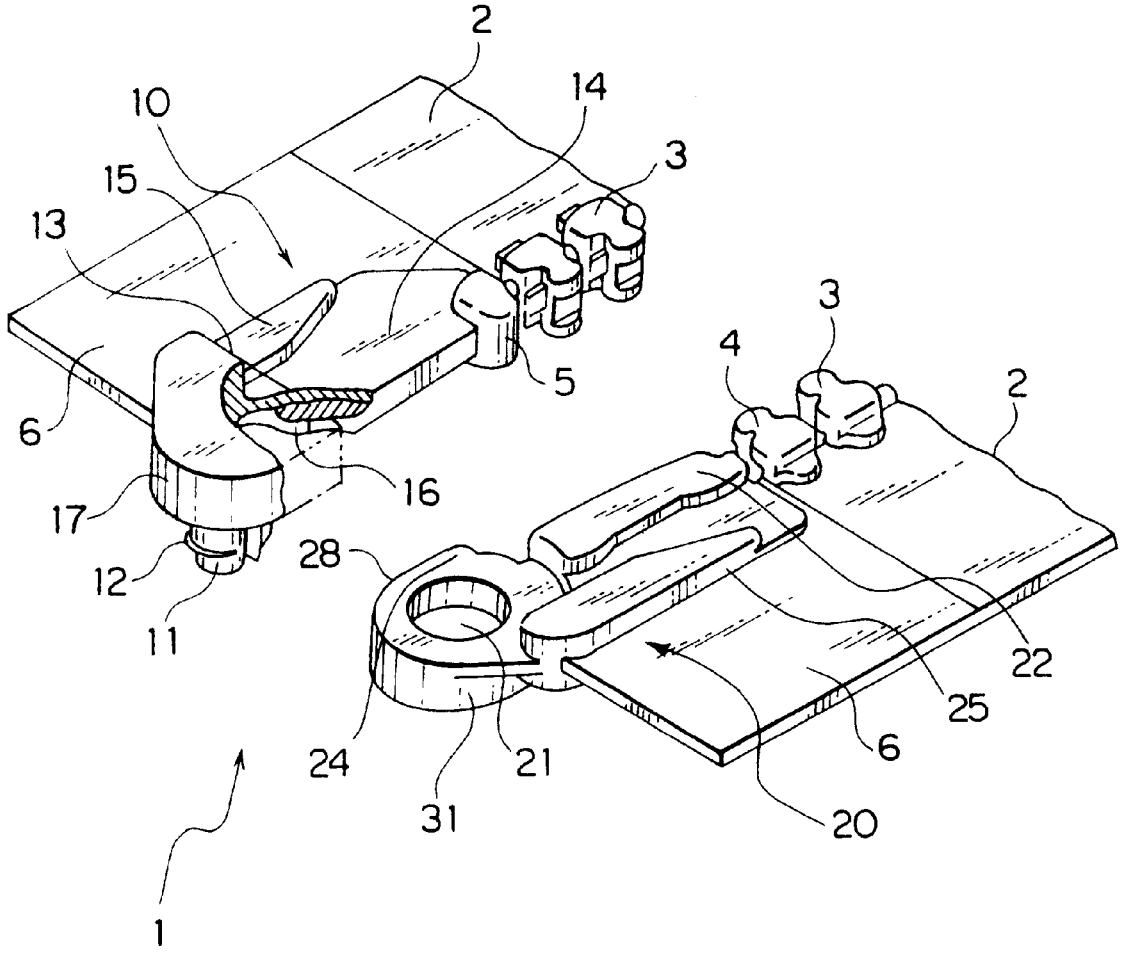
FIG. 1 is a perspective view of a separable bottom stop assembly in a separated state having a separation-preventing mechanism according to a first embodiment of the present invention.

Embodiments of the present invention will be described in detail below based on examples shown in the drawings.

FIGS. 1 to 7 show a separable bottom stop assembly provided with a separation-preventing mechanism for preventing separation in a horizontal direction relative to front and back faces of a slide fastener, and FIGS. 8 to 12 show a separable bottom stop assembly provided with a detachment-preventing mechanism for preventing detachment in a direction perpendicular to front and back faces of the slide fastener.

First, the separable bottom stop assembly provided with the separation-preventing mechanism shown in FIGS. 1 to 7 will be described. The separation-preventing mechanism is provided to a separable bottom stop assembly 1 having a coupling member 10 and a locking member 20. When the coupling member 10 is drawn toward and coupled with the locking member 20, and then rotated to such a position that a slider 7 is ready to be pulled up, the separation-preventing mechanism prevents a separation of the coupling member 10 in a horizontal direction relative to the front and back faces of the slide fastener, i.e. in the pivotal movement direction away from the locking member 20 so that the slider 7 can be easily pulled up.

The separable bottom stop assembly having the separation-preventing mechanism according to the present invention comprises the coupling member 10 and the locking member 20. The coupling member 10 and the locking member 20 are respectively integrally mounted by injection molding synthetic resin material so as to sandwich reinforcing tapes 6 attached to bottom ends of a pair of left and right fastener stringers 2, 2 to which a large number of fastener elements 3 are mounted along opposed inner longitudinal edges of a pair of fastener tapes of the fastener stringers 2, 2.

Figure 3:
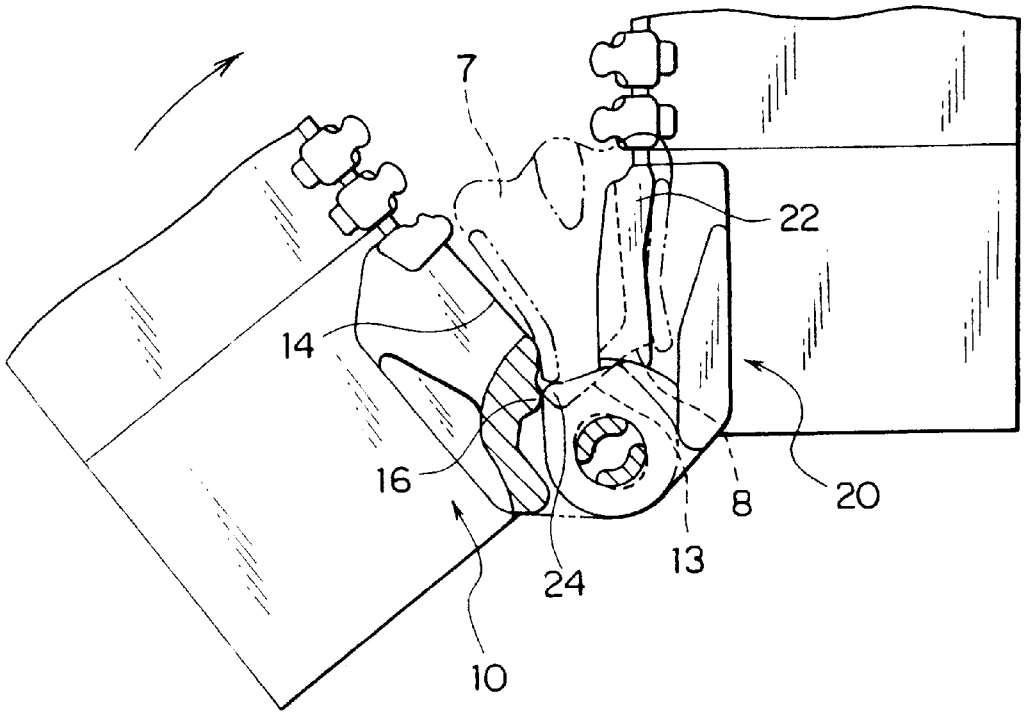
FIG. 3 is a plan view showing a state where a slider abuts on a pivotal abutting portion according to the first embodiment.
Figure 4:
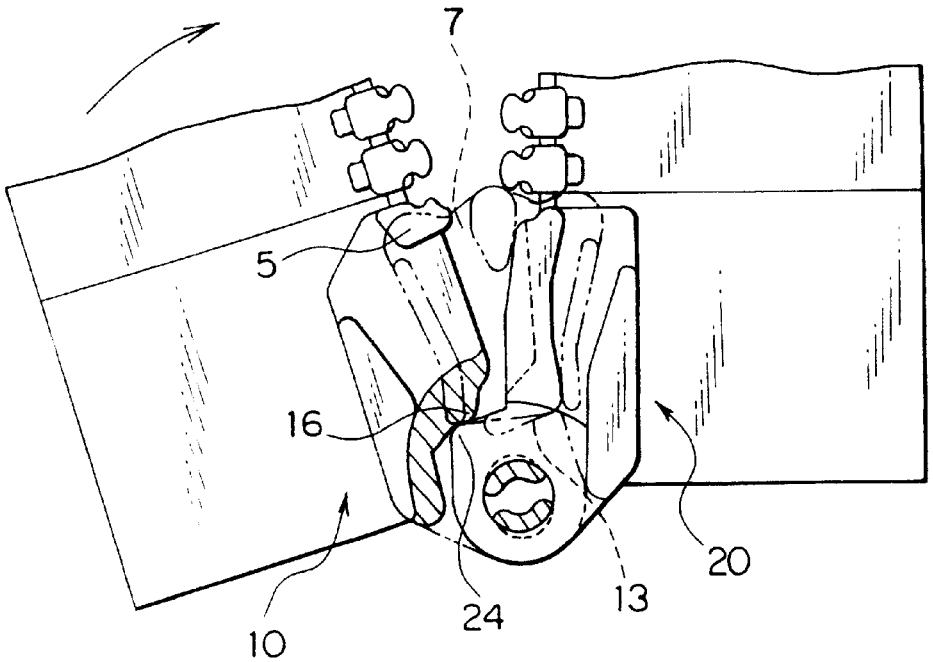
FIG. 4 is a plan view showing a state where a coupling member is rotated or pivotally moved by a slider to a position where the slider can be pulled up according to the first embodiment.

The coupling member 10 has at its lower end a coupling base portion 17 projecting in a hook shape. The coupling base portion 17 has at its lower face two pieces of resilient leg portions 11, 11 which project downward to be snap-fitted into a hole portion 21 of a coupling base portion 31 formed at a lower end of the locking member 20. The resilient leg portions 11 have, at their respective outer peripheral faces, bulging portions 12. The resilient leg portions 11 are pressed and resiliently contract toward its center when the resilient leg portions 11 are inserted into the hole portion 21 of the locking member 20. Then, after the bulging portions 12 of the resilient leg portions 11 pass through the hole portion 21 of the locking member 20, the resilient leg portions 11 resiliently regain their original shapes, so that projections of the bulging portions 12 lock the resilient leg portions 11 at a lower end of the hole portion 21 so that the resilient leg portions 11 are not easily drawn out of the hole portion 21, while the resilient leg portions 11 can be fitted so as to be pivotally movable in the horizontal direction relative to the front and back faces of the slide fastener. The hook-shaped coupling base portion 17 projects on a front face side of the coupling member 10 and an end face of an upper portion of the coupling base portion 17 is a flat face perpendicular to a longitudinal direction of the coupling member 10. The flat face constitutes a pivotal abutting portion 13. As shown in FIGS. 3 and 4, when the slider 7 is pulled down as being guided by a guide portion 22 of the locking member 20, the pivotal abutting portion 13 is pressed by a lower face 8 of the slider 7 so as to rotate or pivotally move the coupling member 10 toward the locking member 20 until a lateral-inserting fitting portion 14, as described later, of the coupling member 10 gets to such a position that the slider 7 can be pulled up. The lateral-inserting fitting member 14 is formed at an inner side edge portion of a middle portion of the coupling member 10 for being fitted into an insertion recessed groove 23 of the locking member 20, and has, at its front and back faces on an outer side thereof, a reinforcing rib 15. The lateral-inserting fitting portion 14 has, at a lower face of a lower end portion thereof, a locking projecting portion 16 which is locked with a projecting portion 24 formed on an outer peripheral wall 28 of the hole portion 21 of the coupling base portion 31 at a lower end of the locking member 20 and prevents the coupling member 10 rotated toward the locking member 20 from being pivotally moved and separated from the locking member 20 in a rotating direction away from the locking member 20. The lateral-inserting fitting portion 14 has, at its end, a fastener element 5 which is coupled with a fastener element 4 at a lowermost end of the opposite fastener stringer 2 and has an inclined angle portion at its back so as to guide the slider 7.

By rotating and coupling the coupling member 10 with the locking member 20, the right and left fastener stringers 2, 2 are drawn toward each other, so that the slider 7 is ready to be pulled up to close the slide fastener. The locking member 20 has at its lower end the coupling base portion 31 projecting in a hook shape. The coupling base portion 31 has at its center the hole portion 21 into which the resilient leg portions 11 of the coupling member 10 are fitted and which is pivotally moved or rotated in a horizontal direction relative to the front and back faces of the slide fastener. The outer peripheral wall 28 of the hole portion 21 has, at its outer surface near its upper outer side, a projecting portion 24 which locks the coupling member 10 and prevents separation of the coupling member 10 away from the locking member 20 in the rotating direction after the locking projecting portion 16 of the coupling member 10 rotates and climbs over the projecting portion 24. The locking member 20 has at its upper portion the guide portion 22 along the inner longitudinal edge portion of the stringer 2 extending up to the end of the locking member 20. The guide portion 22 projects from the front and back faces of the locking member 20 so as to guide the slider 7 which has been pulled down. The reinforcing rib 25 is provided outside the guide portion 22 on the front and back faces of the locking member

Figure 2:
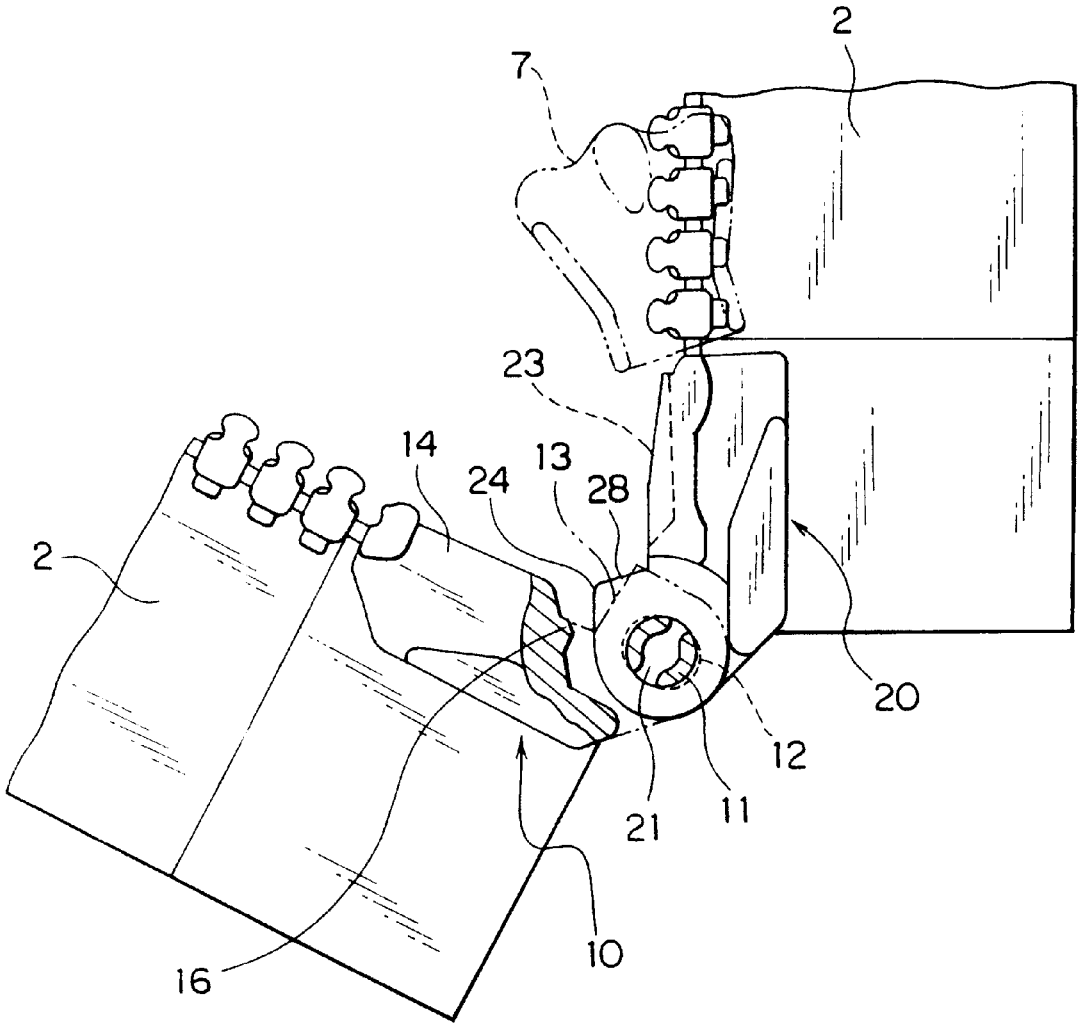
FIG. 2 is a plan view of a separable bottom stop assembly with its bottom ends coupled.

20 at a symmetric position with the reinforcing rib 15 of the coupling member 10. An insertion recessed groove 23 into which a side portion of the lateral-inserting fitting portion 14 of the coupling member 10 is fitted is formed in a side wall portion of the locking member 20 where the guide portion 22 is formed, as shown in FIG. 2. The above lateral-inserting fitting portion 14 and the insertion recessed groove 23 are fitted to each other so as to prevent detachment of the coupling member 10 and the locking member 20 from each other due to a pushing-up load in a direction of the front and back of the slide fastener generated in use of the slide fastener.

Figure 5:
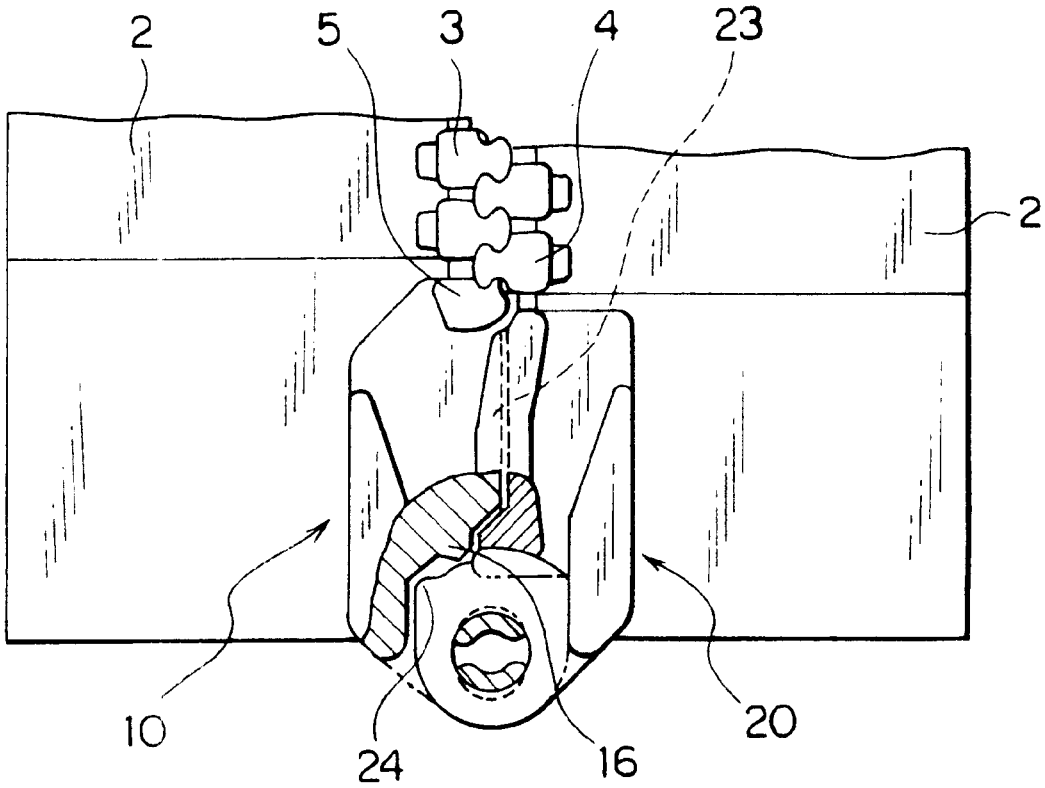
FIG. 5 is a plan view showing a state where the slider has been pulled up and attachment of the separable bottom stop assembly has been completed.

An operation of the separable bottom stop assembly having the separation-preventing mechanism according to the present invention will now be described. FIGS. 2 to 5 show steps of pivotally moving or rotating the coupling member 10 and the locking member 20 and pulling up the slider 7. First, the coupling member 10 and the locking member 20 which are detached as shown in FIG. 1 are drawn toward each other. The resilient leg portions 11 of the coupling base portion 17 at the lower end of the coupling member 10 are resiliently engaged in the hole portion 21 of the coupling base portion 31 at the lower end of the locking member 20 so as to be pivotally movable or rotatable in the horizontal direction relative to the front and back faces of the slide fastener as shown in FIG. 2, by pressing and inserting the bulging portion 12 of the resilient leg portions 11 into the hole portion 21. Then, the slider 7 slidably mounted to the fastener stringer 2 having the locking-member 20 is pulled down as shown in FIG. 3, and the slider 7 is further pulled down until the lower end face 8 of the slider 7 abuts on the pivotal abutting portion 13 of the coupling member 10 as shown in FIG. 4. As a result, an upper portion of the coupling member 10 further rotates in a direction of an arrow in FIG. 4 and the lateral-inserting fitting portion 14 of the coupling member 10 moves closer in a lateral direction to the insertion recessed groove 23 of the locking member 20, so that the coupling member 10 and the locking member 20 are in a position where the slider 7 can be pulled up. At this time, the locking projecting portion 16 formed on a back face of the lower end portion of the lateral-inserting fitting portion 14 of the coupling member 10 is brought into abutment on the projecting portion 24 formed on the outer peripheral wall 28 of the hole portion 21 of the locking member 20. By further rotating the coupling member 10, the locking projecting portion 16 climbs over the projecting portion 24 of the locking member 20 by resiliently deforming the resilient leg portions 11 inwardly and is locked with the projecting portion 24 as shown in FIG. 4, so as to prevent a rotation and separation of the coupling member 10 in a reverse direction from the locking member 20. Therefore, the coupling member 10 is not separated from the locking member 20 without retaining the coupling member 10 by fingers, and the position of the locking member 20 and the state where the slider 7 can be pulled up are maintained. Thus, the slider 7 can be pulled up by a single hand, and as a result, the lateral-inserting fitting portion 14 is fitted into the insertion recessed groove 23 and the left and right fastener stringers 2, 2 are coupled together to close the fastener as shown in FIG. 5.

It is also possible to previously pull the slider 7 down to the lower end of the locking member 20, and then insert and press the resilient leg portions 11 of the coupling member 10 into the hole portion 21 of the locking member 20, and move the coupling member 10 toward the locking member 20 while inserting the locking member 10 from a side to an inside of the slider 7. In this case, the fastener can be operated by the single hand.

In order to separate the left and right fastener stringers 2, 2 from each other, the slider 7 is pulled down to uncouple the coupled fastener elements 3, and the coupling member 10 is pivotally moved or rotated in a reverse direction. By detaching the locking projecting portion 16 of the coupling member 10 from the projecting portion 24 of the locking member 20, an upper portion of the coupling member 10 is separated and detached from the slider 7 as shown in FIG. 3. Then, by drawing the resilient leg portions 11 of the coupling member 10 out of the hole portion 21 of the locking member 20, the left and right fastener stringers 2, 2 are completely separated from each other, so that a garment or the like can be taken off.

Figure 6:
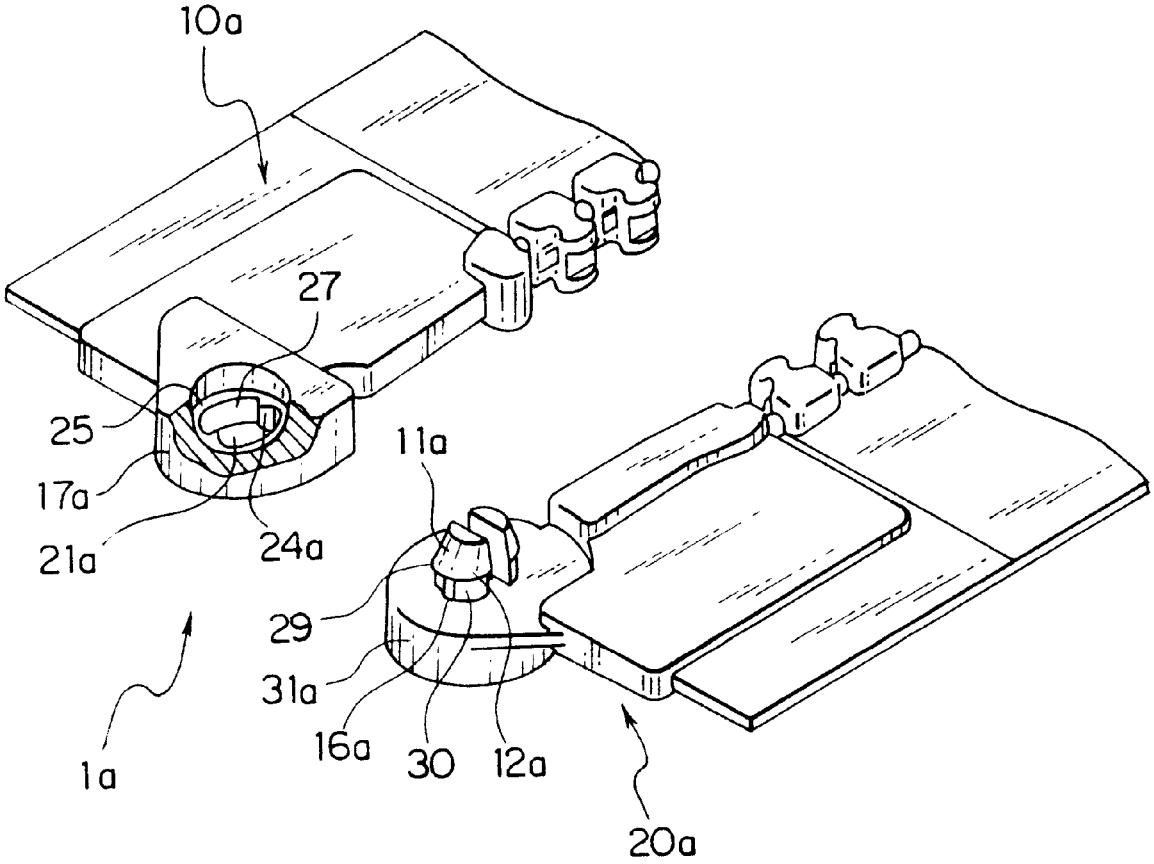
FIG. 6 is a perspective view of the separable bottom stop assembly according to a second embodiment of the present invention.
Figure 7:
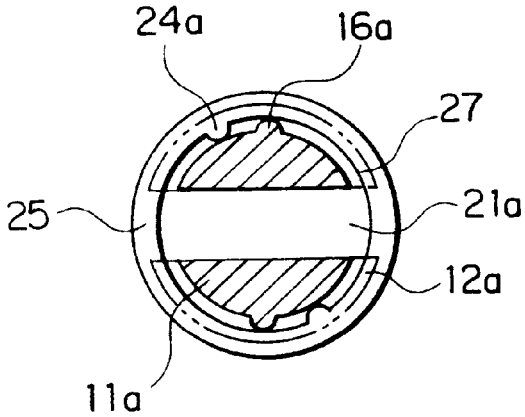
FIG. 7 is a sectional view of a resilient leg portion of the separable bottom stop assembly, with its bottom ends coupled, of the embodiment.

FIGS. 6 and 7 show a second embodiment of the separation-preventing mechanism according to the present invention, having modified mounting positions of resilient leg portions 11*a* and a hole portion 21*a* of coupling base portions 17*a* and 31*a* formed at respective lower ends of a coupling member 10*a* and a locking member 20*a* and a modified disposition position of the separation-preventing mechanism of the coupling member 10*a* and the locking member 20*a* are changed.

A separable bottom stop assembly 1*a* shown in FIG. 6 has the hole portion 21*a* on a side of the coupling member 10*a* and two pieces of resilient leg portions 11*a* on a side of the locking member 20*a*, respectively. The hole portion 21*a* of the coupling member 10*a* is fitted over and resiliently engaged with the two pieces of resilient leg portions 11*a* of the locking member 20*a* so as to be pivotally movable. A bulging portion 12*a* of the leg portion 11*a* of the locking member 20*a* for holding and locking the coupling member 10*a* so that the coupling member 10*a* is not drawn out is defined by forming upper halves of the resilient leg portions 11*a* into a headed cone shape. Step portions 29 formed at middle portions of the resilient leg portions 11*a* as shown in FIG. 6 are locked with an edge portion 25 at an inner periphery of an upper portion of the fitting hole portion 21*a* of the coupling member 10*a*.

As shown in FIGS. 6, and 7, the separation-preventing mechanism comprises projecting portions 24*a* formed on an inner peripheral wall 27 of the hole portion 21*a* of the coupling member 10*a* and locking projecting portions 16*a* formed on outer peripheral walls 30 of lower portions of the resilient leg portions 11*a* of the locking member 20*a* for preventing the coupling member 10*a* from returning in a reverse direction, after the coupling member 10*a* moves close to the locking member 20*a* in such a manner that the slider 7 can be pulled up. The projecting portions 24*a* on the side of the coupling member 10*a* are pressed into contact with the locking projecting portions 16*a* on the side of the locking member 20*a*, and the resilient leg portions 11*a* are forced into the hole portion 21*a* and deformed toward a center side until it regains its original shape, so as to prevent separation of the coupling member 10*a*. In order to detach the coupling member 10*a* from the locking member 20*a*, the coupling member 10*a* is pivotally moved in a reverse direction, so that the projecting portions 24*a* resiliently deform and climb over the locking projecting portions 16*a* of the locking member 20*a* to detach the coupling member 10*a*. Therefore, the coupling base portions 17*a* and 31*a* at the separate lower ends of the coupling member 10*a* and the locking member 20*a* are snap-fitted to each other, so that a state where the slider 7 can be prepared to be pulled up is maintained after the upper portion of the coupling member 10*a* is rotated to move close to the locking member 20*a*. Thus, after that, the slider 7 can be-pulled up by a single hand to easily couple the left and right fastener stringers 2, 2 to close the fastener. Therefore, an operation of the separable bottom stop assembly 1*a* is very easy.

In FIG. 6, the hole portion 21*a* is formed in the coupling member 10*a* , the projecting portions 24*a* are formed on the inner peripheral wall 27 of the hole portion 21*a*. On the other hand, the resilient leg portions 11*a* are provided to the locking member 20*a*, and the locking projecting portions 16*a* are formed on the outer peripheral walls 30 of the resilient leg portions 11*a*. Alternatively, it is also possible, like in the first embodiment shown in FIG. 1, that the locking projecting portions are formed on the outer peripheral walls of the resilient leg portions provided on the coupling member, and the projecting portions are formed on the inner peripheral wall of the hole portion defined on the locking member, so that the coupling member is moved close to and engaged with the locking member and is prevented from being separated in a state where the slider 7 can be pulled up.

FIGS. 8 to 12 show a separable bottom stop assembly having a detachment-preventing mechanism.

First, the separable bottom stop assembly having a detachment-preventing mechanism shown in FIGS. 8 and 9 will be described. The separable bottom stop assembly further includes the detachment-preventing mechanism in addition to the above separation-preventing mechanism so as to further reliably operate the slider 7. When the coupling member 10, 10*a* is drawn close to the locking member 20, 20*a* in such a manner that the slider 7 can be ready to be pulled up, the detachment-preventing mechanism prevents detachment of the coupling member 10, 10*a* and the locking member 20, 20*a* from each other in a direction perpendicular to a direction of the front and back faces of the slide fastener.

Since the separable bottom stop assembly having the separation-preventing mechanism is similar to the above separable bottom stop assembly, only the detachment-preventing mechanism will be described here according to this detachment-preventing mechanism. As shown in FIG.. 8, a hole portion 32 is formed in a center of a coupling base portion 17 of a coupling member 10 while a leg portion 36 is formed projecting in a center of a coupling base portion 31 of a locking member 20. By resiliently engage the leg portion 36 with the hole portion 32 to draw the coupling member 10 toward the locking member 20, the coupling member 10 is rotated and engaged with the locking member 20 so that detachment of the coupling member 10 and the locking member 20 from each other is prevented.

Figure 8:
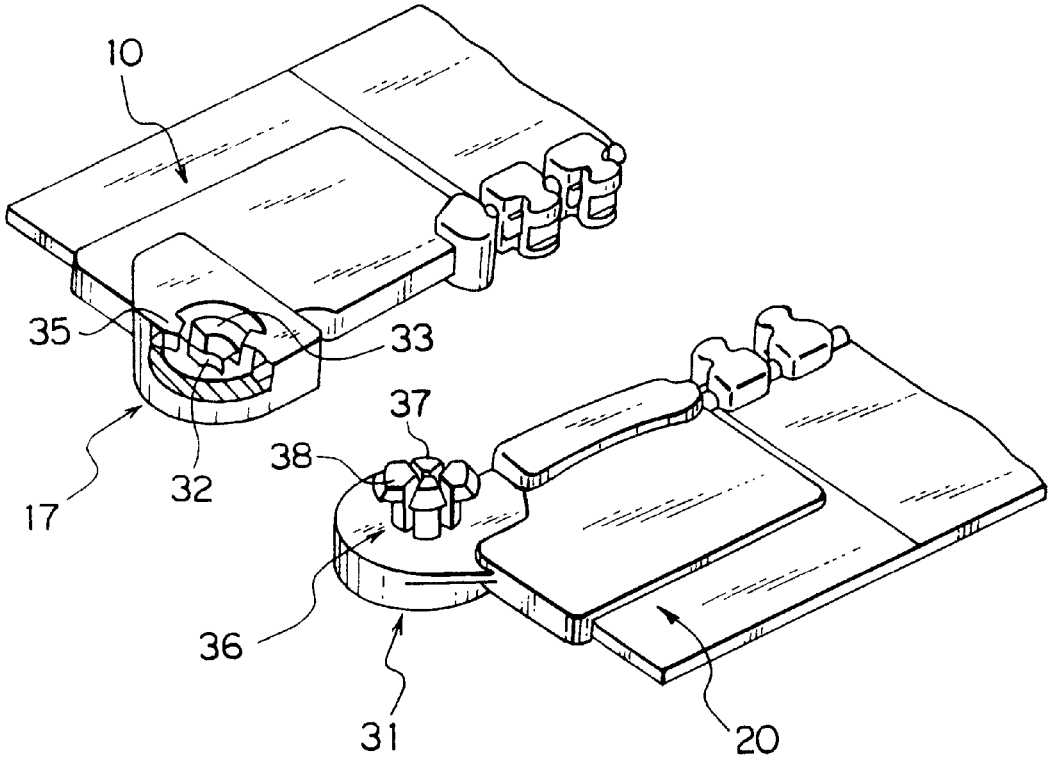
FIG. 8 is a perspective view showing a state where a separable bottom stop assembly having a detachment-preventing mechanism is separated according to a third embodiment of the present invention.

As shown in FIG. 8, the leg portion 36 is formed projecting in a center of an upper face of the coupling base portion 31 of the locking member 20 and comprises four pieces. The respective pieces are disposed at intervals as shown in FIG. 9 and can be resiliently deformed toward its center. Opposed two of the four pieces have, at their respective ends thereof, bulging portions 37 and lower end portions of the two pieces are to be locked with step portions 33 formed in the hole portion 32 of the coupling member 10. The other opposed two of the four pieces have engaging portions 38 having their respective end portions longer than the bulging portions 37 and are to be engaged with the step portions 33 formed in the hole portion 32 of the coupling member 10, so that the coupling member 10 and the locking member 20 are not easily detached from each other.

The two pieces of the leg portion 36 having the engaging portions 38 may be integrally formed, respectively.

Figure 9:
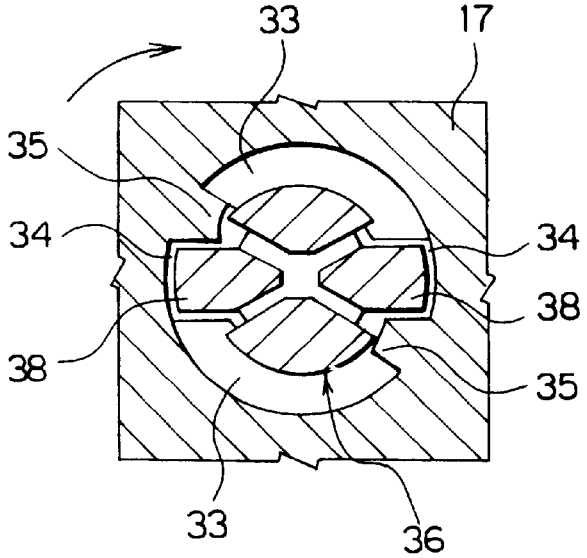
FIG. 9 is a cross-sectional view of an essential portion showing a state where a leg portion and a hole portion is engaged with each other according to the third embodiment.

The hole portion 32 is formed at the center of the coupling base portion 17 of the coupling member 10 and has such a shape that a hole of a smaller diameter is formed through the coupling base portion 17 in a vertical direction, i.e., a front and back direction of the slide fastener, and a larger diameter hole is formed at an upper portion of the hole portion 32 so as to form two symmetric arcs as shown in FIG. 9, thereby forming step portions 33 along edge portions of the smaller diameter hole. Two through-grooves 34 are formed at two positions between the arc-shaped step portions 33 passing through the coupling base portion 17 in a vertical direction of FIG. 8, through which the two pieces of engaging portions 38 of the leg portion 36 can be inserted. Thick projecting portions are formed respectively between the through-grooves 34 and the arc-shaped step portions 33 to constitute rotation restricting portions 35 as shown in FIG.. 8. By moving the coupling member 10 close to the locking member 20, the hole portion 32 rotates, so that the step portions 33 pass along lower ends of the engaging portions 38 of the leg portions 36 and move while being engaged with the step portions 33. When the coupling member 10 is completely coupled with locking member 20, the engaging portions 38 abut on the rotation restricting portions 35 so as to stop the rotation of the hole portion 32. Thus, the engaging portions 38 are locked on the step portions 33, thereby preventing detachment of the coupling member 10 and the locking member 20 from each other in the front and back direction of the slide fastener.

Therefore, the hole portion 32 of the coupling base portion 17 of the coupling member 10 is fitted over the leg portions 36 of the coupling base portion 31 of the locking member 20 from above. In the beginning of the movement of the coupling member 10 toward the locking member 20, engagement of the step portions 33 with the engaging portions 38 starts, so that the operation of the coupling member 10 can be accurate. After the fastener is closed by coupling the coupling member 10 with the locking member 20 and pulling up the slider 7, the coupling member 10 and the locking member 20 are not detached from each other, so as not to deteriorate appearance in use.

Figure 10:
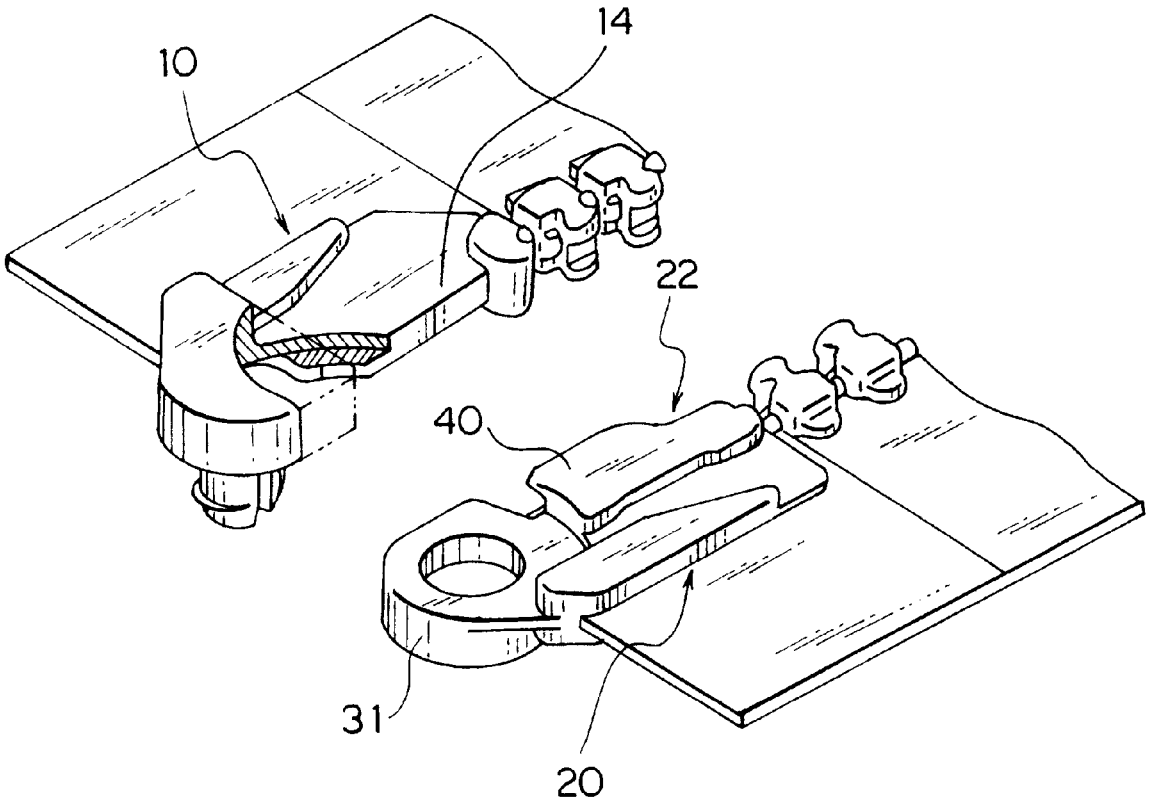
FIG. 10 is a perspective view of a separable bottom stop assembly having a detachment-preventing mechanism according to a fourth embodiment of the present invention.
Figure 11:
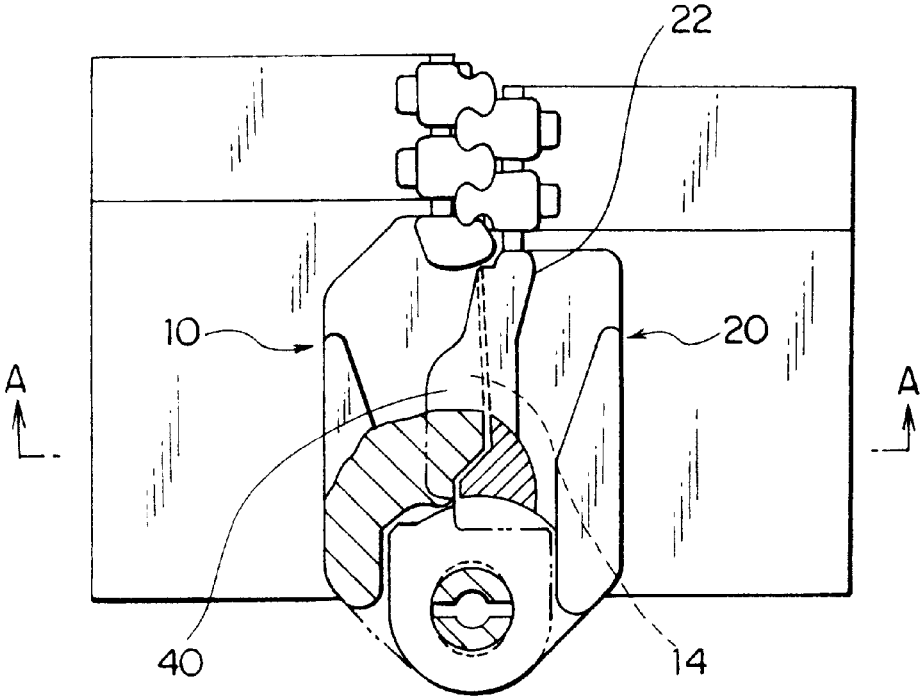
FIG. 11 is a plan view of the completely coupled separable bottom stop assembly of the fourth embodiment.
Figure 12:
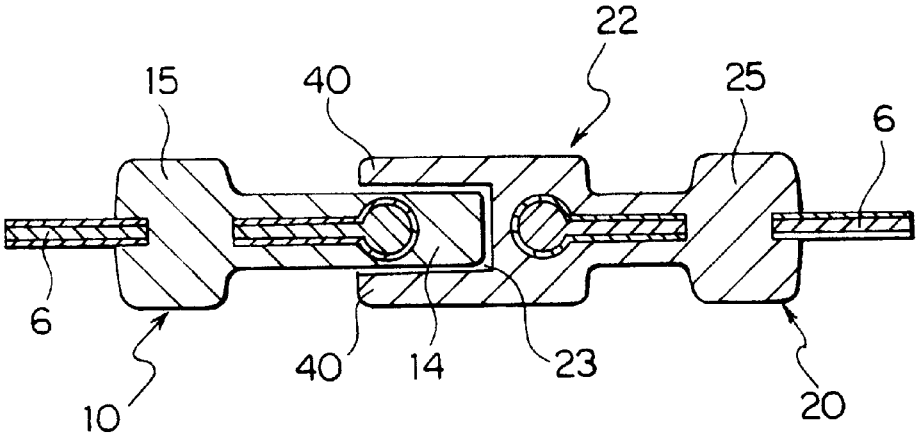
FIG. 12 is a cross-sectional view of the separable bottom stop assembly of the fourth embodiment taken along a line A—A of FIG. 11.

FIGS. 10 and 12 show a fourth embodiment of the separable bottom stop assembly having a modified detachment-preventing mechanism. The detachment-preventing mechanism of the separable bottom stop assembly is formed such that upper and lower projecting walls 40, 40 of a guide portion 22 further largely project at their portions near the coupling base portion 31 such an extent as that the pulling up of the slider is not hindered. The guide portion 22 constitutes the insertion recessed groove 23 of the locking member 20 to which the coupling member 10 is fitted. Therefore, when the coupling member 10 is drawn close to the locking member 20 in such a manner that the slider 7 can be pulled up, a lateral-inserting fitting portion 14 of the coupling member 10 is partially inserted into the insertion recessed groove 23 near the coupling base portion 31 of the locking member 20, thereby preventing detachment of the coupling member 10 and the locking member 20 from each other in a direction perpendicular to the front and back faces of the slide fastener, and facilitating smooth operation of the slider 7. When the coupling member 10 is completely coupled with the locking member 20, since the lateral-inserting fitting portion 14 of the coupling member 10 is deeply inserted into the insertion recessed groove 23 of the locking member 20 as shown in FIGS. 11 and 12, the coupling member 10 and the locking member 20 are not detached form each other even after the fastener is closed by pulling up the slider 7.

The present invention has structures as mentioned above. Therefore, since the separation-preventing mechanism is provided between the coupling member 10, 10*a* and the locking member 20, 20*a* of the separable bottom stop assembly 1, 1*a* of the lateral-inserting type for preventing separation of the coupling member 10, 10*a* from the locking member 20, 20*a*in a horizontal direction relative to the front and back faces of the slide fastener when the coupling member is rotated to a position where the slider 7 is ready to be pulled up, it is unnecessary to retain the coupling member 10, 10*a* in order to pull up the slider to couple the left and right fastener stringers 2, 2 together, and thus, the slider can be operated by a single hand. Therefore, children or people who are handicapped with one of their hands can handle the separable bottom stop assembly, and can easily wear or take off clothes with the fasteners.

Also, since the detachment-preventing mechanism is provided between the coupling member 10, 10*a* and the locking member 20, 20*a* for preventing detachment of the coupling member and the locking member from each other in a direction perpendicular to the front and back faces of the slide fastener when the coupling member 10, 10*a* is rotated to such a position that the slider 7 is ready to be pulled up, the slider can be operated further reliably. Further, since the coupling member 10, 10*a* and the locking member 20, 20*a* are not detached from each other after the fastener is closed and when the garment or the like is in use, the appearance is not deteriorated due to detachment of the separable bottom stop assembly.

Since the pivotal abutting portion 13 is provided at the lower end portion of the coupling member 10, 10*a* of the separable bottom stop assembly 1, 1*a* of the lateral-inserting type, on which the lower end portion of the pulled down slider abuts and which rotates the upper portion of the coupling member 10, 10*a* to such a position that the slider 7 is ready to be pulled up, it is possible to pull down the slider by not both hands but a single hand to easily bring the coupling member 10, 10*a* and the locking member 20, 20*a* into a state where the slider is ready to be pulled up. Therefore, the operation of the separable bottom stop assembly 1, 1*a* can be operated very easily. Furthermore, since the children can easily pull up the slider to close the slide fastener, it is very convenient that such garments with the fasteners can be easily put on and taken off.

What is claimed:

1. A separable bottom stop assembly of a lateral-inserting type of a slide fastener comprising a coupling member and a locking member snap-coupled with each other at lower ends thereof so as to be pivotally movable in a horizontal direction relative to front and back faces of the slide fastener, an upper portion of the coupling member being pivotally moved to be fitted with and separated from a side of the locking member, wherein a separation-preventing mechanism is provided between the coupling member and the locking member for preventing separation of the coupling member in the horizontal direction after pivotally moving the coupling member to such a position that a slider can be pulled up.

2. A separable bottom stop assembly of a slide fastener according to claim 1, wherein a detachment-preventing mechanism is provided between the coupling member and the locking member for preventing detachment of the coupling member in a direction perpendicular to the front and back faces of the slide fastener after pivotally moving the coupling member to such a position that the slider can be pulled up.

3. A separable bottom stop assembly of a slide fastener according to claim 2, wherein the detachment-preventing mechanism includes a hole portion having a step portion provided in either of coupling base portions of lower ends of the coupling member and the locking member, and an engaging portion provided at an end of a leg portion either of the coupling base portions of the lower ends of the locking member and the coupling member, the engaging portion being engaged with the step portion.

4. A separable bottom stop assembly of a slide fastener according to claim 2, wherein the detachment-preventing mechanism includes projecting walls of front and back faces of a guide portion of the locking member which project largely toward the coupling member in such a manner that an insertion recessed groove of the locking member is formed deeply, a lateral-inserting fitting portion of the coupling member being fitted into the insertion recessed groove.

5. A separable bottom stop assembly of a slide fastener according to claim 1, wherein the separation-preventing mechanism includes a locking projecting portion provided at a lower end of a lateral-inserting fitting portion of the coupling member and a projecting portion provided on an outer peripheral wall of a lower end of the locking member.

6. A separable bottom stop assembly of a slide fastener according to claim 1, wherein the separation-preventing mechanism includes a projecting portion provided on an inner peripheral wall of a hole portion formed in either of coupling base portions at the lower ends of the coupling member and the locking member, and a locking projecting portion provided on an outer peripheral wall of a resilient leg portion formed in either of the coupling base portions at the lower ends of the locking member and the coupling member, the resilient leg portion-fitting in the hole portion.

7. A separable bottom stop assembly of a slide fastener according to claim 1, further including a pivotal abutting portion provided at a lower end portion of the coupling member, on which a lower end portion of the slider which has been pulled down abuts and which pivotally moves the upper portion of the coupling member to such a position that the slider can be pulled up.

* * * * *